US008240089B2

(12) United States Patent
Lambertini

(10) Patent No.: US 8,240,089 B2
(45) Date of Patent: Aug. 14, 2012

(54) CARRIAGE FOR SLIDING DOORS AND WINDOWS

(75) Inventor: Marco Lambertini, San Lazzaro di Savena (IT)

(73) Assignee: GSG International S.p.A., Budrio (IT)

( * ) Notice: Subject to any disclaimer, the term of this patent is extended or adjusted under 35 U.S.C. 154(b) by 207 days.

(21) Appl. No.: 12/808,569

(22) PCT Filed: Jun. 27, 2008

(86) PCT No.: PCT/IB2008/001731

§ 371 (c)(1),
(2), (4) Date: Jun. 16, 2010

(87) PCT Pub. No.: WO2009/081240

PCT Pub. Date: Jul. 2, 2009

(65) Prior Publication Data

US 2010/0307064 A1 Dec. 9, 2010

(30) Foreign Application Priority Data

Dec. 21, 2007 (IT) ..... BO2007A0842

(51) Int. Cl.
*E05D 15/06* (2006.01)

(52) U.S. Cl. ..... 49/425; 49/226

(58) Field of Classification Search ..... 49/226, 49/227, 234, 235, 425

See application file for complete search history.

(56) References Cited

U.S. PATENT DOCUMENTS

| | | | | | |
|---|---|---|---|---|---|
| 3,442,052 | A * | 5/1969 | Levine | 49/425 |
| 3,526,995 | A * | 9/1970 | Saunders | 49/420 |
| 3,688,340 | A * | 9/1972 | Schoenbrod | 16/91 |
| 3,879,893 | A * | 4/1975 | Helmick | 49/420 |
| 4,064,593 | A * | 12/1977 | Helmick | 16/105 |
| 4,262,451 | A * | 4/1981 | Dallaire | 49/425 |
| 4,404,771 | A | 9/1983 | Murase et al. | |
| 5,791,089 | A * | 8/1998 | Prevot et al. | 49/425 |
| 5,845,363 | A * | 12/1998 | Brempell et al. | 16/105 |
| 5,860,189 | A * | 1/1999 | An | 16/91 |
| 7,293,389 | B2 * | 11/2007 | Jacobs | 49/425 |
| 7,594,358 | B2 * | 9/2009 | Harari et al. | 49/425 |
| 2004/0163317 | A1 | 8/2004 | Reich et al. | |
| 2009/0013605 | A1 * | 1/2009 | Seo | 49/279 |

FOREIGN PATENT DOCUMENTS

| | | | |
|---|---|---|---|
| DE | 78 16 563 | U1 | 12/1980 |
| EP | 1 298 271 | A2 | 4/2003 |
| EP | 1 298 272 | A2 | 4/2003 |
| EP | 1 437 471 | A2 | 7/2004 |
| NL | 6 914 256 | A | 5/1970 |
| WO | WO 2007073027 | A1 * | 6/2007 |

* cited by examiner

*Primary Examiner* — Katherine W Mitchell
*Assistant Examiner* — Justin Rephann
(74) *Attorney, Agent, or Firm* — Pearne & Gordon LLP

(57) ABSTRACT

Described is a carriage (7) for sliding doors and windows (2) comprising a fixed frame (3), at least one sash (4) that is slidable horizontally relative to the fixed frame (3) by means of a carriage unit (1), and a handle (9) mounted on the sash (4) for controlling the carriage (7); the latter is provided with a supporting frame (11), mobile on wheels, and with a connecting member (13) interposed between the supporting frame (11) and a bottom sash (4) rail (8); the connecting member (13) is movably constrained to the supporting frame (11) to enable the sash (4) to be lifted and lowered relative to the supporting frame (11) under the action of the handle (9); a helical spring (44) is interposed between the supporting frame (11) and the connecting member (13) to lessen the effort required of the user to lift the sash (4).

6 Claims, 5 Drawing Sheets

CARRIAGE FOR SLIDING DOORS AND WINDOWS

TECHNICAL FIELD

This invention relates to a carriage for sliding doors and windows, in particular forming part of a carriage unit for doors and windows of the type known in the jargon of the trade as "lift and slide".

BACKGROUND ART

These doors and windows normally comprise:

a fixed frame;

at least one mobile frame, or sash, that slides horizontally relative to the fixed frame between an open position and a closed position;

at least one sliding unit, or carriage unit, associated with the bottom sash rail and resting on a horizontal base track to enable the sash to slide in both directions to and from the open and closed positions;

a control handle mounted on the sash and enabling the sash firstly to be lifted so as to move the sides of the track away from the weather-strips at the bottom of the sash to allow the latter to slide to and from the open and closed positions, and secondly to be lowered when it reaches the closed position so that the weather-strips seal the door or window substantially hermetically;

locking/unlocking means acting between the vertical member of the sash and the fixed frame to lock/unlock the sash in the closed position under the action of the handle.

This text focuses on the carriage unit which, in most of the constructional solutions currently available on the market, comprises a pair of carriages (main and secondary) so as to support the sliding sash in a balanced manner.

Usually, as is known for example from prior patent publications DE 7816563U, EP 1.298.271, EP 1.298.272, EP 1.437.471, each carriage comprises: a box-shaped frame that supports at its ends a pair of wheels designed to run on the track; and a connecting member interposed between the box-shaped frame and the bottom of the sliding sash to enable the sash to be lifted and lowered relative to the box-shaped frame.

In particular, in a prior art structure, the connecting member is, on one side, connected to the bottom of the sash and, on the other, connected to the box-shaped frame by a coupling between a pin and an inclined slot (applied to, and formed in, the box-shaped frame and connecting member, or vice versa, depending on the solution adopted).

The movement of the connecting member (and of the sash) relative to the box-shaped frame of the carriage is imparted by the above mentioned control handle through a drive system which changes the relative position between the pin and the inclined slot.

In the solutions known up to now, the movement for lifting the sash requires a considerable effort of the user, especially if the sash handle, for aesthetic reasons, has a relatively short control lever.

DISCLOSURE OF THE INVENTION

This invention has for an aim to provide a carriage unit for sliding doors and windows which is free of the above mentioned disadvantage and which, in particular, permits the use of short lever handles without thereby obliging the user to make an excessive effort to lift the sash.

According to the invention, this aim is achieved by providing a carriage unit for sliding doors and windows comprising the characteristics defined in one or more of the appended claims.

BRIEF DESCRIPTION OF THE DRAWINGS

The invention will now be described by way of non-limiting example with reference to the accompanying drawings in which.

DETAILED DESCRIPTION OF THE PREFERRED EMBODIMENTS OF THE INVENTION

Figure 1:
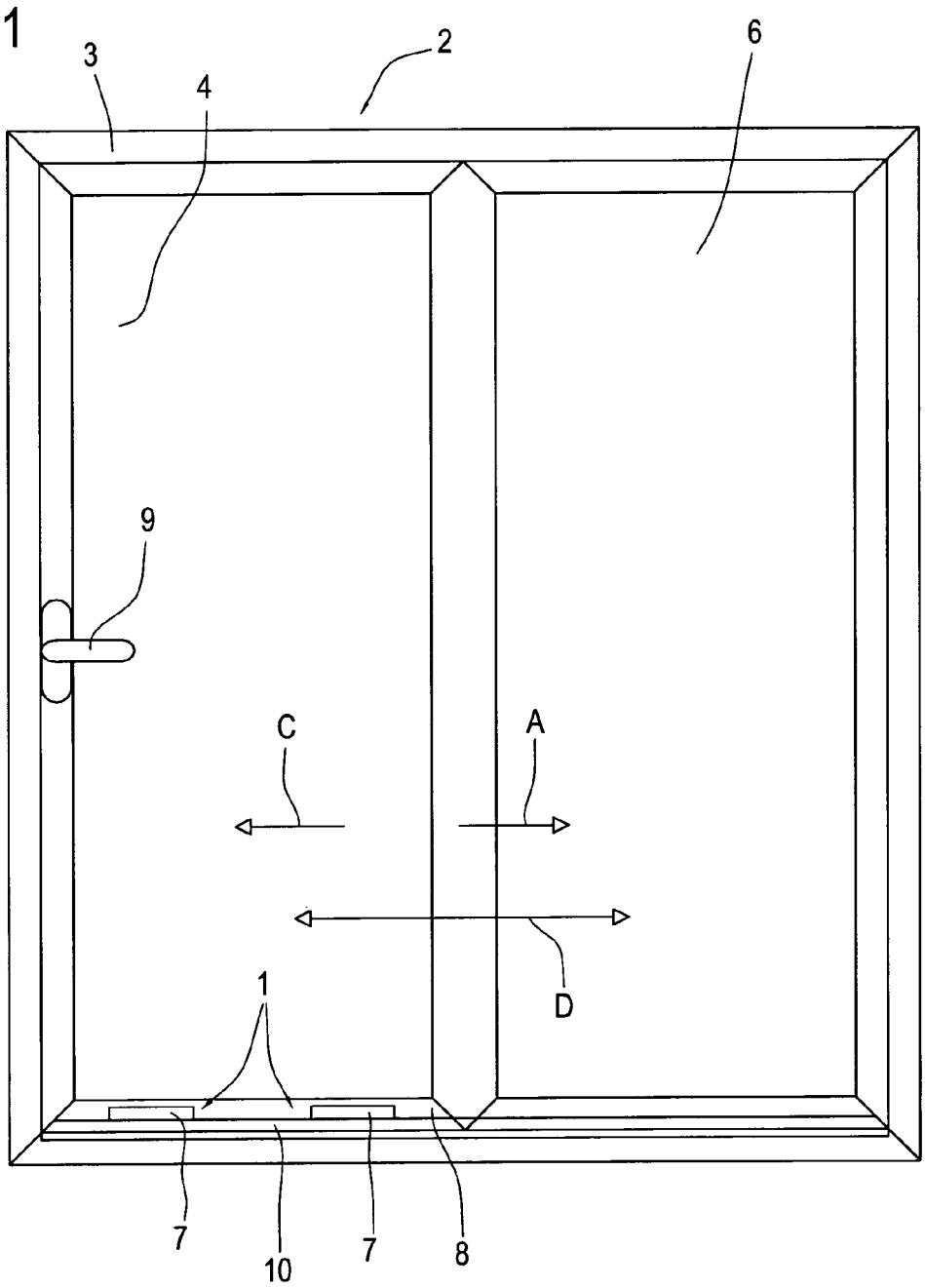
FIG. 1 schematically illustrates lift and slide door/window fitted with a carriage made according to the present invention.

With reference to the accompanying drawings, in particular FIG. 1, the carriage according to the invention is part of a carriage unit, denoted in its entirety by the numeral 1, which in turn forms part of a "lift and slide" door/window 2.

Besides the carriage unit 1, the door/window 2 also comprises a fixed frame 3 and a mobile frame 4, or sash 4, having weather-strips 10 at least at the bottom of it.

The sash 4 is slidable relative to the fixed frame 3 between a closed position (see FIG. 1) and an open position (not illustrated).

More specifically, the sash 4 is slidable horizontally in a direction D, FIG. 1, on a fixed track 5 positioned at the base of the frame 3 and, in its fully open position (not illustrated), can (by way of example) be superposed over a fixed sash 6.

The carriage unit 1 normally comprises a pair of identical carriages 7, each of which is associated with the bottom rail 8 of the sash 4 and runs in the guide track 5 to enable the sash 4 to move to and from the open and closed positions.

The carriage 7 located in front of the other carriage 7 in the closing direction C of the sash 4 will hereinafter be referred to as the "main carriage". The other carriage will, instead, be referred to as "secondary".

The door/window 2 also comprises a control handle 9 mounted on the sash 4 and enabling the sash 4 firstly to be lifted so as to move the sides of the track 5 away from the weather-strips 10 at the bottom of the sash 4 to allow the sash 4 to slide to and from the open and closed positions, and secondly to be lowered when it reaches the closed position so that the weather-strips 10 seal the door/window 2 substantially hermetically.

As illustrated in detail in FIGS. 2 to 5, each carriage 7 comprises a supporting frame 11 in the form of a partially open, substantially parallelepiped shaped box.

In the vicinity of its two longitudinal ends, the frame 11 rotatably supports and partly contains a wheel 12 by which the carriage 7 is slidably constrained to the track 5.

Each carriage 7 also comprises a connecting member 13 interposed between the box-shaped frame 11 and the sash 4 rail 8 to enable the sash 4 to be lifted and lowered relative to the frame 11.

Figure 2:
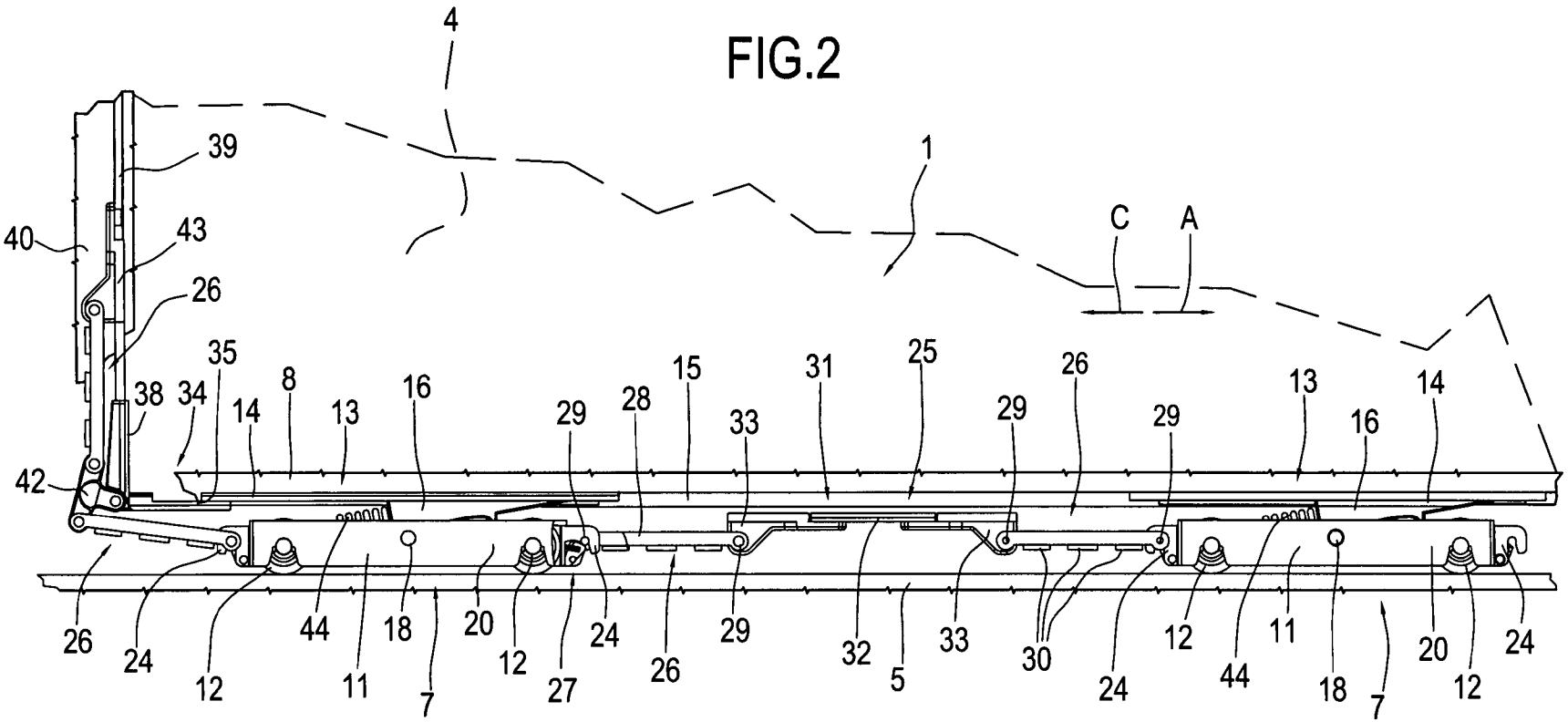
FIG. 2 is a side view of a carriage unit comprising the carriage according to the invention and forming part of the door/window of FIG. 1.
Figure 3:
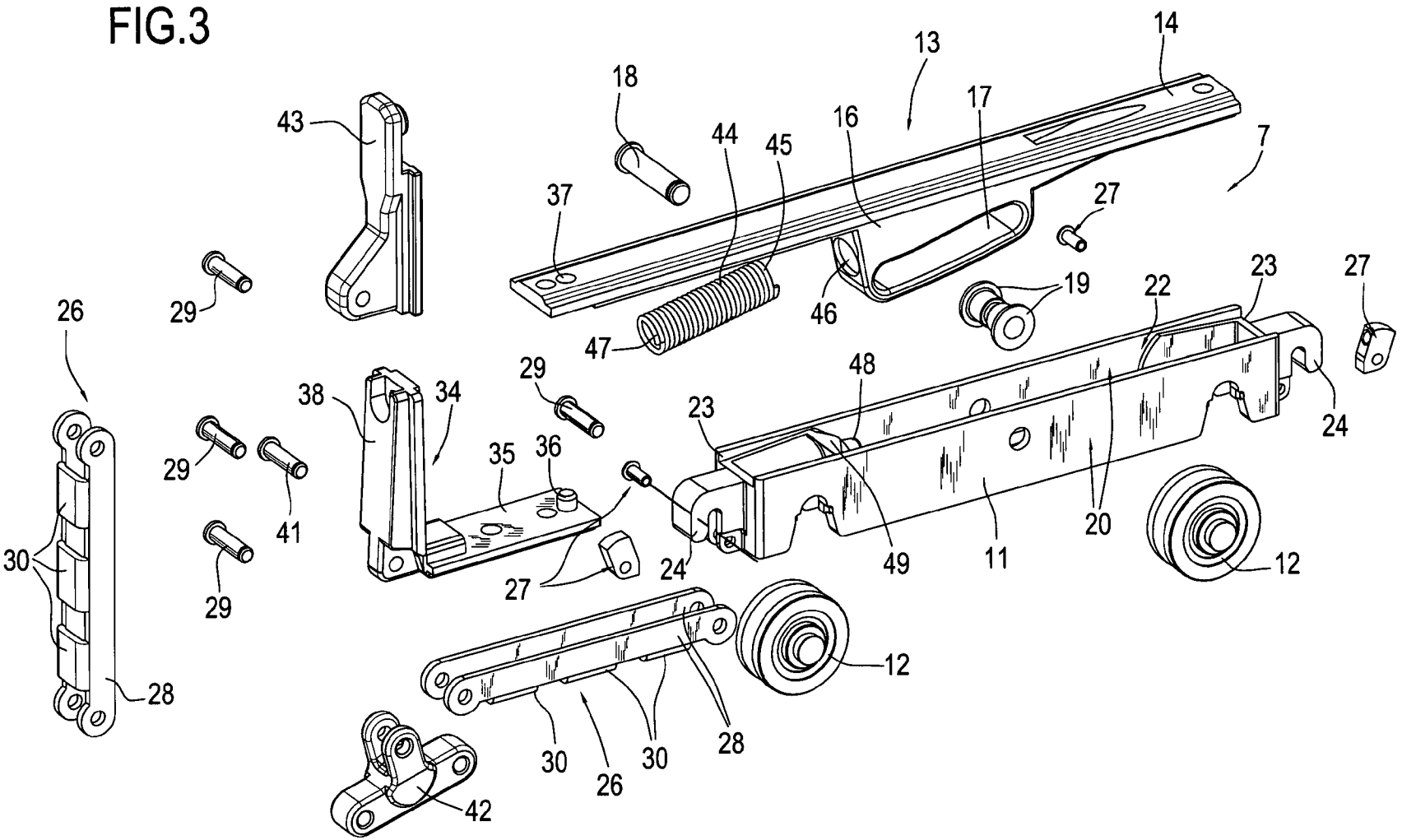
FIG. 3 is a perspective exploded view of a detail from FIG. 2.
Figure 4:
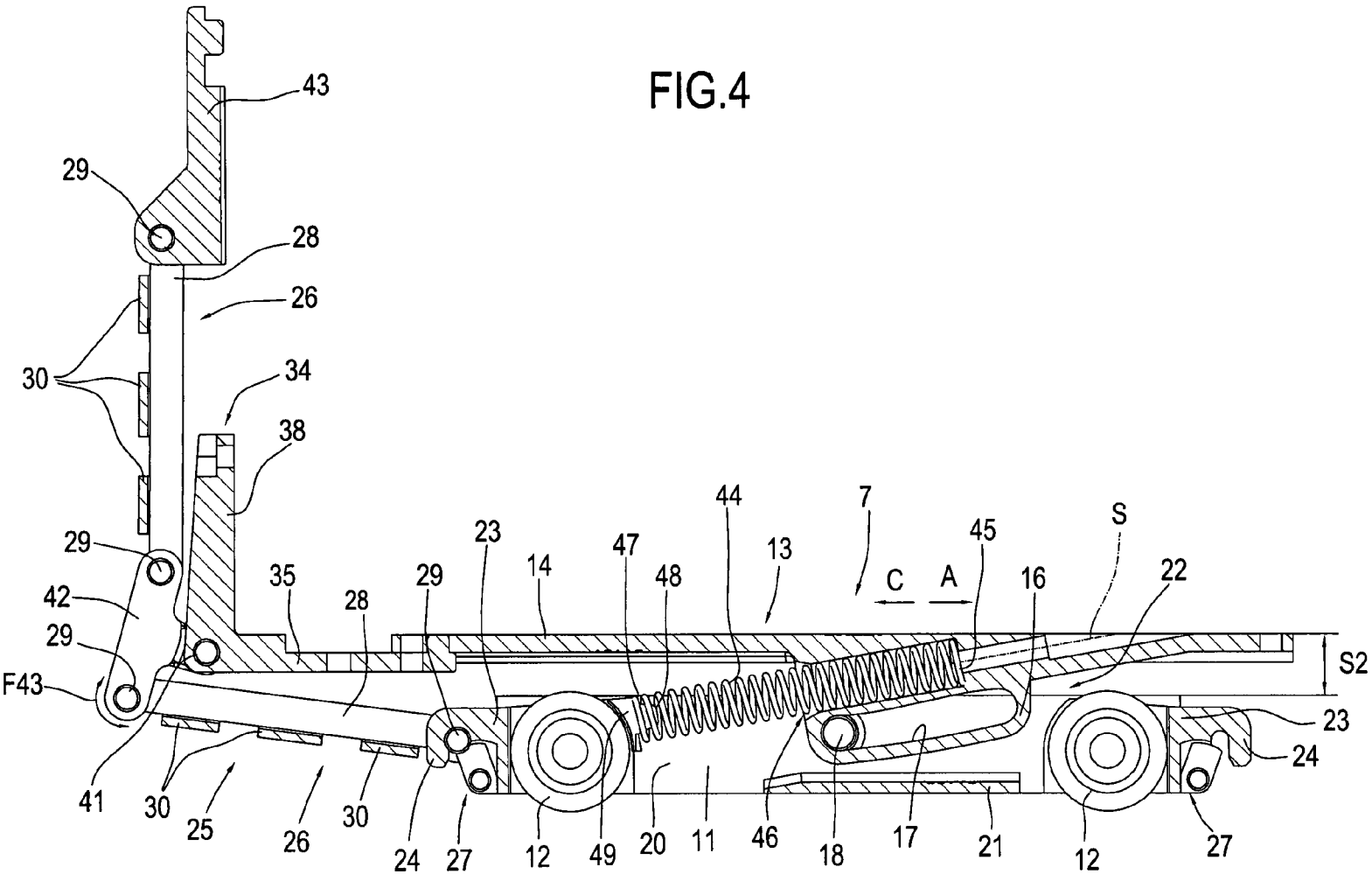
FIGS. 4 and 5 show the detail of FIG. 3 in respective operating positions.

The member 13 comprises a substantially rectangular upper plate 14 fitted in a groove 15 at the bottom of the rail 8 (illustrated schematically in FIG. 2 since it does not strictly fall within the scope of the invention).

As will become clearer as this description continues, each carriage 7 is provided with elastic means, interposed between the member 13 and the frame 11 and being in particular in the form of a helical spring 44, designed to facilitate the lifting of the sash 4.

From a middle portion of the plate 14 there extends a bottom protrusion 16 of the connecting member 13 by which the latter is movably constrained to a central portion of the frame 11.

More specifically, the protrusion 16 has an elongated slot 17 that is inclined in such a way that its lower end is in front of the upper end in the above mentioned sash 4 closing direction C.

The slot 17 is engaged by a central pin 18 of the frame 11 through a pair of bushes 19. The pin 18 extends between two vertical side walls 20 of the frame 11 at right angles to the walls 20 themselves.

The walls 20 are connected to each other by a bridge 21, or bottom wall 21, which extends squarely across the walls 20, while at the top they delimit a rectangular opening 22 through which the protrusion 16 is partially contained within the frame 11.

The walls 20, substantially rectangular in shape, are also connected to each other at their front and back ends by two walls 23 which extend squarely across the walls 20 themselves.

Each wall 23 integrally mounts a hook shaped protrusion 24 extending outside the frame 11 and designed to connect the carriages 7 to each other within a drive system 25 controlled by the handle 9.

In particular, each protrusion 24 is designed to be linked to a connecting frame 26 by a quick locking/unlocking element 27 (not described in detail since it does not strictly fall within the scope of the invention).

Each frame 26 in the drive system 25 comprises a pair of long, rigid parallel rods 28 facing each other.

The rods 28, substantially rectangular in shape, are connected to each other at the longitudinal ends of the respective pins 29 which extend at right angles between the rods 28 and by which each protrusion 24 can be hooked and hinged to the frame 26.

For completeness of description, the rigid rods 28 are joined to each other in an integrated structure by a plurality of stiffening bridges 30 extending transversally across the rods 28 themselves.

More specifically, the bridges 30 are positioned side by side to form alternate full and empty spaces along the rods 28.

The drive system 25, which forms part of the carriage unit 1, comprises a drive unit 31 fitted between the carriages 7 which are connected to it through the two interposed connecting frames 26.

The drive unit comprises a central rod 32 with two end drives 33 fixed to its longitudinal ends. Each drive 33 is hinged to the respective connecting frame 26 by the aforementioned pin 29.

The drive system 25 also comprises an L-shaped bracket 34 having a first arm 35 connected to the plate 14 of the main carriage 7. More specifically, the arm 35 has an end pin 36 that engages a hole 37 at the end of the plate 14 and is fixed to the plate 14 by screw fastening means which are not illustrated.

The bracket 34 also has a second arm 38 extending squarely from the arm 35 and fixed to the inside of a groove 39 in the vertical stile 40 of the sash 4 which, when closed, abuts the fixed frame 3. In other words, the bracket 34 is positioned at the bottom corner of the sash 4, where the stile 40 and the rail 8 meet, and is integral with the sash 4.

At the point where the arms 35 and 38 meet, there is hinged by means of a pin 41 one of the three ends of a T-shaped corner toggle or fitting 42. At its two other ends, the fitting 42 of the drive system 25 is also hinged on one side to a frame 26, which is in turn connected to the main carriage 7, and on the other side to another frame 26 in turn connected to a drive slider 43.

The drive slider 43 of the drive system 25 is slidably housed in the above mentioned groove 39 and is connected in known manner that is not illustrated to the handle 9.

For completeness of description, the door/window 2 comprises locking/unlocking means (not described because they are outside the scope of the invention) which act between the vertical stile 40 of the sash 4 and the fixed frame 3 to lock/unlock the sash 4 in the closed position under the action of the handle 9.

Figure 5:
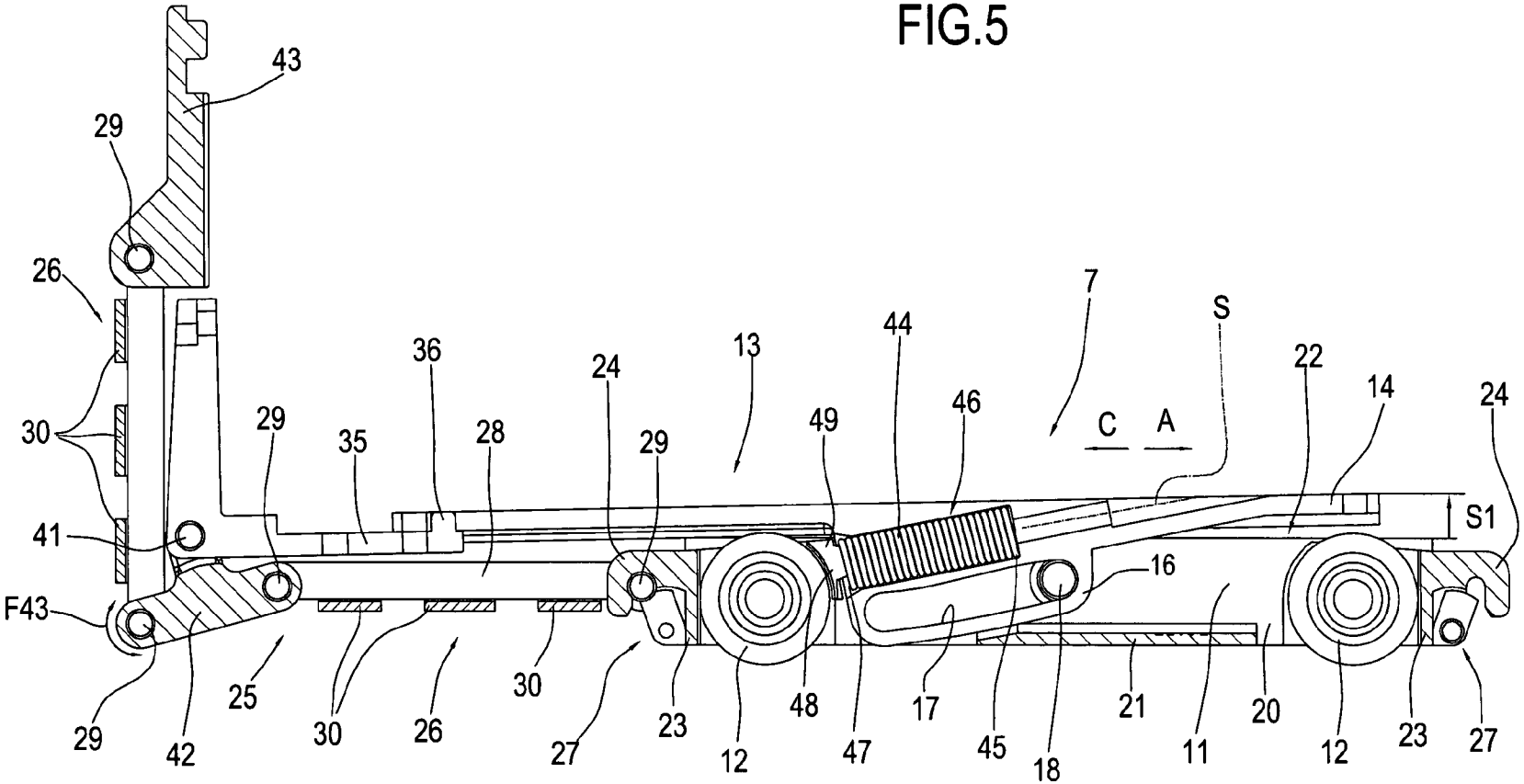

In use, starting from the configuration of the carriage unit 1 illustrated in FIG. 5, operation of the handle 9 unlocks the sash 4 and imparts a vertical lifting movement to the drive slider 43. This movement results in a rotation (clockwise in FIG. 5, arrow F43) of the fitting 42 followed by a movement of both the carriages 7 in the direction C. Since the sash 4, when it is in the closed position, abuts the fixed frame 3, the movement of the carriages 7 in the direction C causes the respective connecting members 13, and hence the sash 4, to be lifted from the frames 11 until the carriage unit 1 reaches the configuration illustrated in FIGS. 2 and 4 (see distances S1 and S2, FIGS. 4 and 5).

At this point, the weather-strips 10 are disengaged from the track 5, allowing the sash 4 to slide in the opening direction A.

In each carriage 7, the movement of the connecting member 13 relative to the frame 11 is caused by the action of elastic means embodied, in particular by a helical spring 44.

One longitudinal end 45 of the spring 44 is inserted into a cylindrical hole 46 in the connecting member 13, while the other end 47 accommodates a supporting pin 48 of the frame 11.

More specifically, the hole 46 is formed in the protrusion 16, between the plate 14 and the slot 17, and extends longitudinally along a central axis S parallel to the direction in which the slot 17 extends, while the pin 48 protrudes towards the opening 22 from an inside wall 49 of the frame 11.

The wall 49 is positioned between the walls 20, close to the wheel 12 that is positioned at the front of the other in the closing direction C of the sash 4.

In the top limit position where the connecting member 13 is raised off the frame 11 (see FIG. 4), the helical spring 44 is extended and only partially contained within the hole 46, while the bottom limit position where the connecting member 13 is down on the frame 11 (see FIG. 5), the helical spring 44 is compressed and all the way inside the hole 46.

Thus, in each carriage 7, the lifting movement of the member 13 of the box-shaped frame 11 is facilitated by the extension of the helical spring 44, which, on the contrary, exerts an opposing action tending to stop the movement of the member 13 in the opposite direction.

In other words, the elastic energy stored by the helical springs 44 when the sash 4 is lowered to the closed position is returned when it is opened, thus lessening the effort the user is required to make to lift it.

Thanks to this feature, it is easy for the user to lift the sash 4, although the handle 9 has a relatively short control lever, with obvious aesthetic advantages.

It should also be noticed that the carriage unit 1 made in this way, besides achieving the above mentioned aim, has a mechanically simple and robust structure.

Moreover, the use of simple helical springs 44 and the effectiveness of their position within the carriages 7 makes the carriage unit 1 reliable and inexpensive to manufacture.

To this we must add that the spring 44 is conveniently housed in a part of the carriage 7 that would otherwise be unused: that means the original structure of the carriage 7 is not modified.

The parallel positioning architecture of the spring and slot optimizes, thus making the most of, the force generated by the spring to lift and lower the sash.

The invention described above is susceptible of industrial application. The invention may also be modified and adapted in several ways without thereby departing from the scope of the inventive concept. Moreover, all the details of the invention may be substituted by technically equivalent elements.

The invention claimed is:

1. A carriage for sliding doors and windows; said doors and windows (2) comprising:

a fixed frame (3), at least one sash (4) that slides relative to the, fixed frame (3) horizontally on at least one carriage (7) between an open position and a closed position, and a handle (9) mounted on the sash (4) and designed to control the carriage (7); the carriage (7) being provided with a supporting frame (11), mobile on wheels, and with a connecting member (13) interposed between the supporting frame (11) and a bottom sash (4) rail (8); the connecting member (13) being movably constrained to the supporting frame (11) to enable the sash (4) to be lifted and lowered relative to the supporting frame (11); the carriage (7) also comprising a drive system (25) whereby the handle (9) controls the lifting and lowering of the sash (4) relative to the supporting frame (11) of the carriage (7); the carriage (7) further comprising elastic means (44) interposed between the supporting frame (11) and the connecting member (13); wherein the elastic means (44) are in the form of a helical spring (44); wherein the connecting member (13) comprises an upper plate (14) coupled to the bottom rail (8) of the sash (4), and a bottom protrusion (16) extending from a middle portion of the plate (14) and movably constrained to a central portion of the supporting frame (11); the helical spring (44) being interposed between the protrusion (16) and the supporting frame (11);

and wherein the protrusion (16) has a cylindrical hole (46) which accommodates one longitudinal end (45) of the spring (44); the supporting frame (11) comprising a pin (48) that fits into the other longitudinal end (47) of the spring (44).

2. The carriage according to claim 1, characterized in that the protrusion (16) comprises an elongated slot (17) engaged by a central pin (18) of the supporting frame (11).

3. The carriage according to claim 2, characterized in that the cylindrical hole (46) is made in the protrusion (16) between the plate (14) and the slot (17) and extends longitudinally along a central axis (S) parallel to the direction in which the slot (17) extends.

4. The carriage according to claim 2, characterized in that the slot (17) is inclined in such a way that its lower end is located in front of its upper end in the closing direction (C) of the sash (4).

5. The carriage according to claim 1, characterized in that the supporting frame (11) is in the form of a partially open, substantially parallelepiped shaped box and, more specifically, has a bottom wall (21) opposite an upper opening (22), two side walls (20) extending transversally from the bottom wall (21), and two further walls (23) at its front and back ends, extending transversally from both the bottom wall (21) and the side walls (22); the protrusion (16) being partially contained within the supporting frame (11) through the upper opening (22).

6. A sliding door or window of the lift and slide type comprising the carriage (7) according to claim 1.

* * * * *